United States Patent [19]

Tu

[11] Patent Number: 4,687,076

[45] Date of Patent: Aug. 18, 1987

[54] SEGMENT CONNECTOR FOR MODULAR LADDER

[76] Inventor: Nan-Hsing Tu, No. 11, Lane 116, Sec. 3, Fu Hsing Rd., Taichung, Taiwan

[21] Appl. No.: 920,586

[22] Filed: Oct. 17, 1986

[51] Int. Cl.[4] ..... E06C 1/10

[52] U.S. Cl. ..... 182/178; 182/194; 403/108; 403/325

[58] Field of Search ..... 182/178, 179, 194, 195; 403/108, 325, 328

[56] References Cited

U.S. PATENT DOCUMENTS

| | | | |
|---|---|---|---|
| 303,721 | 8/1884 | Gates | 182/178 |
| 550,175 | 11/1895 | Holden | 182/178 |
| 704,884 | 7/1902 | Lally | 182/178 |
| 1,548,518 | 8/1925 | Edlich | 182/178 |
| 2,473,388 | 6/1949 | Rambo | 182/178 |
| 2,474,722 | 6/1949 | Blume | 403/108 |
| 3,336,060 | 8/1967 | Bradford | 403/108 |
| 4,086,980 | 5/1978 | Shortes | 182/178 |

FOREIGN PATENT DOCUMENTS

| | | | |
|---|---|---|---|
| 669132 | 8/1963 | Canada | 182/178 |

*Primary Examiner*—Reinaldo P. Machado

*Attorney, Agent, or Firm*—Arnold, White & Durkee

[57] ABSTRACT

A segment connector to connect two segments of a modular ladder which have through holes near ends of the segments includes: a connector housing having a top open end, a bottom open end, and a side wall, the connector housing being sleeved partially over one of the two segments through one of said top and bottom open ends; a rivet insertable through rivet holes in the connector housing and the sleeved segment to pass completely therethrough to fix the connector housing sleevedly on the segment; a hook means rotatably mounted on the rivet inside the segment, the hook means including a releasing button means; and a spring means wound around the rivet and connected to the hook means to bias the hook means to project out of the connector housing; wherein, when the connector is further sleeved on the other of the two segments, the hook means normally is biased to pass holes of the segment and to project out of holes of the connector housing means, whereby the segments and the connector are firmly engaged together, the releasing button means further acting against the biasing action of the spring means when pressed, releasing the segments and the connector from the engagement.

7 Claims, 4 Drawing Figures

SEGMENT CONNECTOR FOR MODULAR LADDER

BACKGROUND OF THE INVENTION

This invention relates to a connector, particularly to a connector for connecting two segments of a modular ladder which the height can be adjusted as desired, the connector of this invention being of simple construction, easily assembled and disassembled with segments of the ladder, and able to create a firm and safe engagement between the segments of the ladder.

Conventional ladders of different types have been used for many thousands of years. They are formed in a fixed shape with a definite length, which gives them the disadvantage of being difficult to store and impossible to adjust to allow users thereof to climb to varying heights. Folding ladders have been developed, to save a certain amount of space, but the problem of unadjustability has not been overcome.

A modular ladder which could be completely disassembled would provide maximum efficiency in terms of space required to store the ladder, and would also allow the ladder to be formed of segments of which the quantity could be varied to achieve different heights of the ladder. However, ladder segments of such a ladder must be easily connected together, for convenience in use, and the connection is desirably as safe and strong as if the ladder formed were of one piece.

SUMMARY OF THE INVENTION

The object of this invention is to provide a segment connector for a modular ladder, which is of simple construction and which can be assembled and disassembled easily with segments of the modular ladder to form a strong connection between the segments.

This and other objects of the invention are achieved by providing a segment connector to connect two segments of a modular ladder which have through holes near ends of the segments, including:

- a connector housing having a top open end, and a bottom open end and a side wall, the side wall having rivet holes and a hook hole means, the connector housing being sleeved partially over one of the two segments through one of the top and bottom open ends;
- a rivet insertable through the rivet holes in the connector housing and the sleeved segment to pass completely therethrough to fix the connector housing sleevedly on the segment;
- a hook means rotatably mounted on the rivet inside the connector housing and the segment, the hook means including a releasing button means; and
- a spring means wound around the rivet and connected to the hook means to bias the hook means to project out of the connector housing through the hook hole means.

When the connector is further sleeved on the other of the two segments through the other of the top and bottom open ends, the hook means normally is biased to pass through the hole of the segment and to project out of the connector housing through the hook hole means, whereby the segments and the connector are firmly engaged together. The releasing button means further acts against the biasing action of the spring means when pressed, releasing the hook means from the holes, and the segments and the connector from the engagement.

In one aspect of the invention, the hook hole means comprises two hook holes disposed opposite from each other on the side wall, and the hook means comprises two hook bodies, each hook body including a base rotatably mounted on the rivet, and a long, curved hook end, the hook ends facing opposing directions from each other. The spring means is connected at two ends thereof to the hook ends to bias the hook ends to extend out of the connector housing and the segment through the hook holes and two of the holes in the segment.

In another aspect of the invention, the connector housing further includes a button groove in the side wall, axially colinear with the hook hole means, and the releasing button means projects outwardly of the connector housing and one of the segments through the button groove.

In a further aspect of the invention, the side wall has four sides substantially forming a box, and the rivet holes are located at two opposing sides of the side wall, while the hook hole means is located in a side adjacent to the opposing sides.

In yet another aspect of the invention, the hook hole means comprises two hook holes disposed opposite from each other on opposite sides of the side wall, the opposite sides being adjacent to the sides containing the rivet holes; wherein the hook means comprises two hook bodies, each hook body including a base rotatably mounted on the rivet, and a long, curved hook end, the hook ends facing opposing directions from each other, the spring means being connected at two ends thereof to the hook ends to bias the hook ends to extend out of the connector housing and the segment through the hook holes and two of the holes in the segment;

and wherein the releasing button means comprises two releasing buttons respectively disposed on the hook ends, protruding therefrom in a same direction as the hook ends curve respectively.

In still another aspect of the invention, the connector housing further includes a button groove means in the side of the side wall including the hook holes means, axially colinear with the hook hole means, and the releasing button means projects outwardly of the connector housing and one of the segments through the button groove.

In another aspect of the invention, the connector housing further includes two button grooves in the sides of the side wall including the hook holes, axially colinear with the hook holes, and the releasing buttons project outwardly of the connector housing and one of the segments through the button groove respectively.

A preferred embodiment of the invention will be described below with reference to the appended drawings, in which:

DRAWINGS

DETAILED DESCRIPTION OF THE INVENTION

The following is a detailed description of the presently most preferred embodiment of this invention. This description is not to be taken in a limiting sense but is made for the purpose of illustrating the invention.

Figure 1:
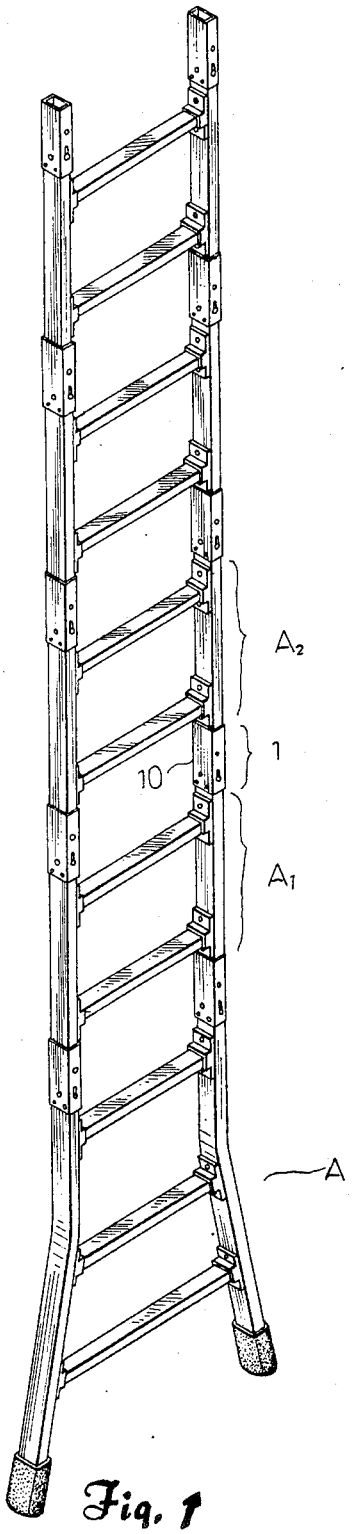
FIG. 1 is a perspective view of a modular ladder including a preferred embodiment of the segment connector of this invention.
Figure 2:
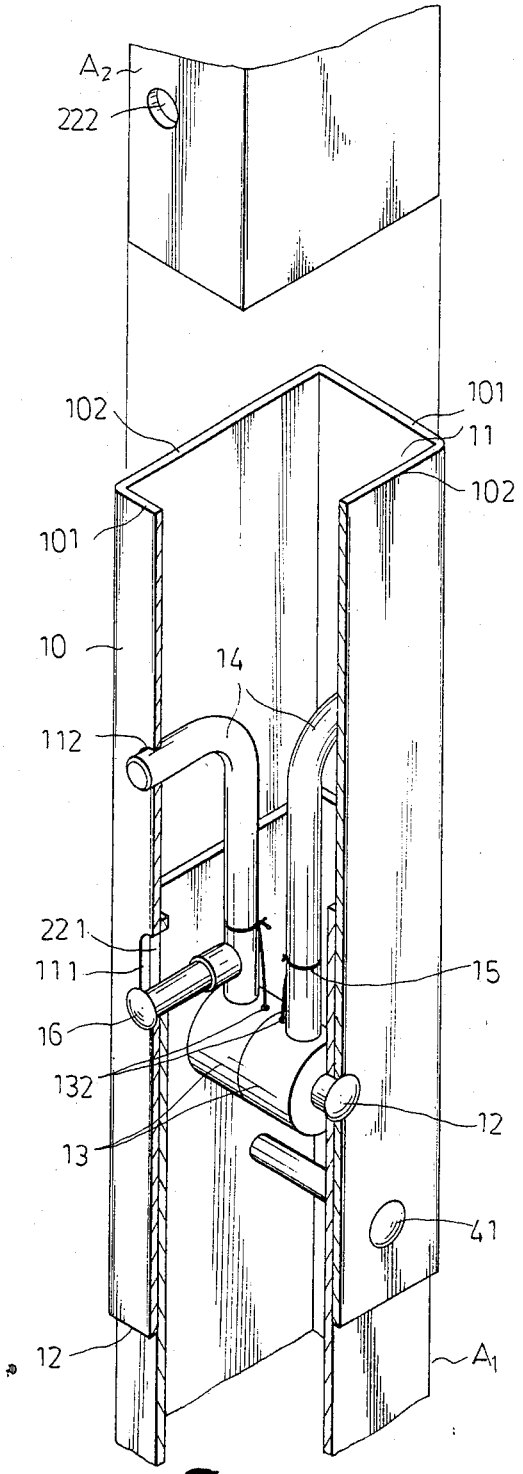
FIG. 2 is a perspective view of the segment connector of FIG. 1.
Figure 3:
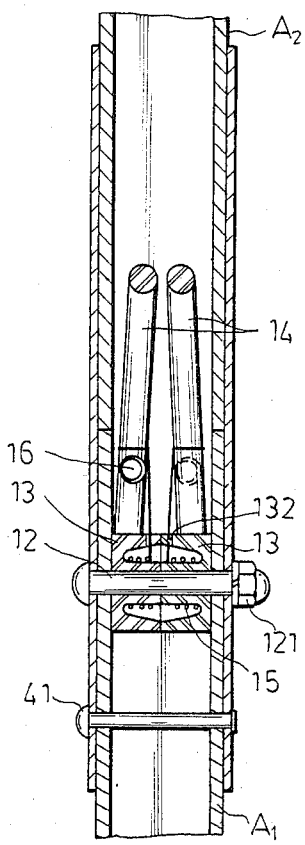
FIG. 3 is a side sectional view of the segment connector of FIG. 1 as seen when a side including a hook hole is removed.
Figure 4:
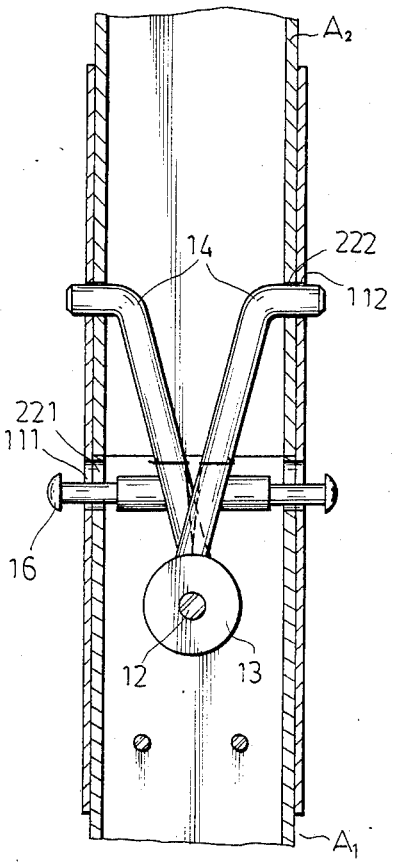
FIG. 4 is a side sectional view of the segment connector of FIG. 1 as seen when a side including a rivet hole is removed.

Referring to FIGS. 1–4, a preferred embodiment of a segment connector for a modular ladder according to this invention connects two segments of a ladder, a lower segment A1 and an upper segment A2. The segment connector according to this invention includes a connector body 1, the connector body 1 including a connector housing 10, a a hook means for interlocking the connector housing 10 and the segments A1,A2, a spring means for biasing the hook means, and various holes and grooves for receiving the hook means.

The connector housing 10 in a substantially box-like shape, having a top open end 11, a bottom open end 12 and a side wall with four sides, two opposing first sides 101 having respective hook holes 112 therein and longitudinally extending button grooves 11 therein each linearly aligned axially of the respective side 101 with the hook hole 112, and two opposing second sides 112 adjacent to the first sides 101 having rivet holes therein respectively. The housing 10 is sleeved partially over the lower segment A1 through its lower end 12.

A first rivet 12 is inserted through the rivet holes of second sides 102 and rivet holes of the lower segment A1 to pass completely therethrough and is fixed in position by a nut 121. The housing 10 is thus fixed on the lower segment A1. To further strengthen the connection, a second rivet 41 is inserted through the connector housing 10 and the lower segment A1 through other rivet holes in the second sides 102 and in the lower segment A1.

A hook means is rotatably mounted on the rivet 12. The hook means comprises two hook bodies, each hook body including a hollow cylindrical base 13 rotatably mounted on the rivet 12, and a long, curved hook end 14, the hook ends 14 facing opposing directions from each other. A releasing button 16 projects from a portion of the hook end 14 near the base 13, perpendicularly to the hook end 14 in the same direction as the hook end 14 curves. Spring 15 is wound around the rivet 12 in the cylindrical bases 13 and has two ends which protrude from small holes 132 in the cylinder body 13 adjacent to the hook ends 14 and which are attached to the hook ends 14. The spring 15 is coiled in such a way that it normally biasses the hook ends 14 away from each other. It can be understood that when the releasing buttons 16 are pressed, the hook ends 14 will approach each other against the biasing force of the spring 15. Furthermore, as the releasing buttons 16 are loacted near the base 13, the amount of force required to press the hook ends 14 is less than than the biasing force on the hook ends 14 at their tips, so the releasing button 16 is easy to operate but the connection is strong. The connector housing 10 is further sleeved on the upper segment A2 through the top open end 11 so that the hook ends 14 are biased to pass through holes of the upper segment A2 and to project out of the connector housing 10 through the hook holes 112, providing a firm connection thereat.

The releasing buttons 16 pass though button grooves 111 of the lower segment A1 and button grooves 221 of the connector housing 10.

In use, the connector housing 10 is first sleeved halfway over lower segment A1 so that their respective rivet holes overlap. Rivet 41 is first inserted to fix the connector housing 10 and segment A1 in relation to each other. Then, rivet 12 is inserted through the connector housing 10 and the lower segment A1, through the spring 15 and base 13 of the hook means, and back out through the connector housing 10 and lower segment A1, where it is fixed by the nut 121. In this condition, the releasing buttons 16 project from the button grooves 111,221. The releasing buttons 16 are then pressed towards each other, and the connector housing is sleeved over the upper segment A2 until the tips of the hook ends 14 are aligned with hook holes 112 of the connector housing and holes 222 of the upper segment A2. The releasing buttons are then released, and the hook ends 14 project through the holes 112, 222, creating a firm connection thereat. When it is desired to disassemble the ladder, the parts are disassembled in reverse order.

It can be understood that the segment connector of this invention provides a strong connection between segments of the ladder, that the assembly thereof is easy and swift, and that the invention is of simple construction, thus inexpensive to manufacture.

While this invention has been described by means of a preferred embodiment, it is apparent that many modifications and variations can be made without departing from the scope of the invention. It is therefore intended that the invention be limited as indicated in the appended claims.

What I claim is:

1. A segment connector to connect two segments of a modular ladder which have through holes near ends of the segments, including:

a connector housing having a top open end and a bottom open end and a side wall, the side wall having rivet holes and a hook hole means, the connector housing being sleeved partially over one of the two segments through one of the top and bottom open ends;

a rivet insertable through the rivet holes in the connector housing and the sleeved segment to pass completely therethrough to fix the connector housing sleevedly on the segment;

a hook means rotatably mounted on the rivet inside the connector housing and the segment, the hook means including a releasing button means; and a spring means having two ends, wound around the rivet and connected to the hook means to bias the hook means to project out of the connector housing through the hook hole means;

wherein, when the connector is further sleeved on the other of the two segments through the other of the top and bottom open ends, the hook means normally is biased to pass through the hole of the segment and to project out of the connector housing through the hook hole means, whereby the segments and said connector are firmly engaged together, said releasing button means further acting against the biasing action of said spring means when pressed, releasing said hook means from said holes, and said segments and said connector from said engagement.

2. A segment connector for a modular ladder as claimed in claim 1, wherein said hook hole means comprises two hook holes disposed opposite from each other on said side wall, and said hook means comprises two hook bodies, each hook body including a base rotatably mounted on said rivet, and a long, curved hook end, said hook ends facing opposing directions from each other, said spring means being connected at said two ends to said hook ends to bias said hook ends to extend out of said connector housing and said segment through said hook holes and two of said holes in said segment.

3. A segment connector for a modular ladder as claimed in claim 1, wherein said connector housing further includes a button groove in said side wall, axially colinear with said hook hole means, and said releasing button means projects outwardly of said connector housing and one of said segments through said button groove.

4. A segment connector for a modular ladder as claimed in claim 1, wherein said side wall has four sides substantially forming a box, and said rivet holes are located at two opposing sides of said side wall, while said hook hole means is located in a side adjacent to said opposing sides.

5. A segment connector for a modular ladder as claimed in claim 4, wherein said hook hole means comprises two hook holes disposed opposite from each other on opposite sides of said side wall, said opposite sides being adjacent to said sides containing said rivet holes; wherein said hook means comprises two hook bodies, each hook body including a base rotatably mounted on said rivet, and a long, curved hook end, said hook ends facing opposing directions from each other, said spring means being connected at two ends thereof to said hook ends to bias said hook ends to extend out of said connector housing and said segment through said hook holes and two of said holes in said segment; and wherein said releasing button means comprises two releasing buttons respectively disposed on said hook ends, protruding therefrom in a same direction as said hook ends curve respectively.

6. A segment connector for a modular ladder as claimed in claim 4, wherein said connector housing further includes a button groove means in said side of said side wall including said hook holes means, axially colinear with said hook hole means, and said releasing button means projects outwardly of said connector housing and one of said segments through said button groove.

7. A segment connector for a modular ladder as claimed in claim 5, wherein said connector housing further includes two button grooves in said sides of said side wall including said hook holes, axially colinear with said hook holes, and said releasing buttons project outwardly of said connector housing and one of said segments through said button grooves respectively.

* * * * *